US005211447A

United States Patent [19]

Sedlmayr et al.

[11] Patent Number: 5,211,447

[45] Date of Patent: May 18, 1993

[54] SAFETY BELT FASTENING DEVICE

[75] Inventors: Gerhard Sedlmayr; Peter Eckmann, both of Hamburg; Alfred Liensdorf, Norderstedt; Jan Baumann, Uetersen, all of Fed. Rep. of Germany

[73] Assignee: Autoflug GmbH & Co. Fahrzeugtechnik, Rellingen, Fed. Rep. of Germany

[21] Appl. No.: 944,016

[22] Filed: Sep. 11, 1992

Related U.S. Application Data

[63] Continuation-in-part of Ser. No. 607,876, Nov. 1, 1990.

[30] Foreign Application Priority Data

Nov. 1, 1989 [DE] Fed. Rep. of Germany ..... 3936306

[51] Int. Cl.[5] ..... A47C 31/00

[52] U.S. Cl. ..... 297/468; 297/480; 280/806; 24/640; 24/642

[58] Field of Search ..... 297/468, 473, 474, 475, 297/480, 482; 280/801, 802, 804, 805, 806, 807, 808; 24/640, 641, 642, 633

[56] References Cited

U.S. PATENT DOCUMENTS

| | | | |
|---|---|---|---|
| 4,447,017 | 5/1984 | Iaukai | 297/480 X |
| 4,545,097 | 10/1985 | Wier | 24/642 |
| 4,913,497 | 4/1990 | Knabel et al. | 297/480 |
| 4,944,531 | 7/1990 | Knabel et al. | 280/806 |
| 4,999,004 | 3/1991 | Skanberg et al. | 297/480 |
| 5,039,127 | 8/1991 | Föhl | 297/480 X |

FOREIGN PATENT DOCUMENTS

| | | | |
|---|---|---|---|
| 43239 | 1/1982 | European Pat. Off. | 24/642 |
| 0300469 | 7/1988 | European Pat. Off. . | |
| 306299 | 3/1989 | European Pat. Off. | 297/429 |

OTHER PUBLICATIONS pp. 28, 29 "Safer Belt" from Popular Science Sep. 1989.

*Primary Examiner*—Kenneth J. Dorner
*Assistant Examiner*—James M. Gardner
*Attorney, Agent, or Firm*—Robert W. Becker & Associates

[57] ABSTRACT

In a safety belt fastening device for a safety belt system having a belt-tightening device which acts on the fastening device of the belt and a fastening tongue which can be latched in the fastening device, whereby the fastening device comprises a fastener body having a fastening mechanism for the fastening tongue and a spring-loaded release button which acts on the fastening mechanism, it is ensured that even at the end of the belt-tightening process the operating button is within reach in an accessible position for the person who is strapped in. To this purpose, it is provided that the release button is formed in two parts with two button portions which are coupled together, which are movable in relation to each other and of which one button portion follows the movement of the fastener body during the belt-tightening process and the other button portion, after the completion of the belt-tightening process, stands in the operating position preset by the rest position of the fastener body.

11 Claims, 4 Drawing Sheets

SAFETY BELT FASTENING DEVICE

This application is a continuation-in-part of application Ser. No. 607,876 filed Nov. 1, 1990.

BACKGROUND OF THE INVENTION

The invention relates to a safety belt fastening device for a safety belt system having a belt-tightening device which acts on the fastening device and a belt fastening tongue that is latched in the fastening device, whereby the fastening device comprises a fastener body having a fastening mechanism for the fastening tongue and a spring-loaded release button which acts on the fastening mechanism.

A safety belt system having a belt-tightening device that acts upon the fastening device of the belt is shown for example in EP-A-0 300 469 which proposes that during tightening of the belt the fastening device is drawn by way of a mechanical drive in the direction of the underbody of the motor vehicle, whereby the belt portion of the safety belt system which acts on the fastening tongue is tightened. In so far as, in the case of such a safety belt system, there is used a standard safety belt fastening device with a fastening tongue which can be latched in the fastening device, a fastening mechanism and a spring-loaded release button acting on the fastening mechanism, it follows, as a disadvantage, that the safety belt fastening device as a whole at the end of the belt-tightening movement is concealed, for example, within the seat pad of the vehicle seat or between a bracket and the vehicle seat and is no longer accessible for release by freeing of the fastening tongue, because the release button provided on the fastening device for the passenger, who is strapped in, is no longer within reach after a belt-tightening process has been carried out.

The underlying object of the invention is therefore to make available a safety belt fastening device for a safety belt system with a belt-tightening device which acts on the fastening device, the release button of which fastening device is accessible at the end of the belt-tightening movement, as an operating element.

The solution to the problem of achieving this object, including advantageous arrangements and developments, follows from the content of the claims which are placed after this description.

SUMMARY OF THE INVENTION

According to the present invention there is provided a safety belt fastening device for a safety belt system having a belt-tightening device which acts on the fastening device and a fastening tongue which can be latched in the fastening device, whereby the fastening device comprises a fastener body having a fastening mechanism for the fastening tongue, and a spring-loaded release button which acts on the fastening mechanism, the release button being formed in two parts with two button portions which are coupled together, are movable in relation to one another and of which one button portion follows the movement of the fastener body of the fastening device in the belt-tightening process and the other button portion at the end of the belt-tightening process stands in an operating position preset by the rest position of the fastener body. The advantage resulting from the two-part release button is that one button portion, despite the movement of the fastener body, remains in the operating position usual for the person strapped in so that the person who is strapped in is able to actuate this button portion even after a belt-tightening process has occurred, and by so doing can easily undo the fastening device and thus take off the safety belt.

According to one embodiment of the invention, the release button is composed of a first upper button portion which is accessible for operation and a second lower button portion which is connected with the fastener body, with the second button portion following the movement of the fastener body during the belt-tightening process. For the purpose of compensating the opposed movement connected therewith of the two button portions, the upper first button portion is inserted into the lower second button portion and is coupled with the second button portion by way of a connection which can be undone in opposition to the direction of the release movement of the button and is made fast in the direction of the unlocking movement of the button, preferably by way of interlocking tooth constructions.

For the purpose of actuating the fastening mechanism, clearance is provided between the first button portion and the second button portion in a guide housing, with the clearance area being fixed in the directions of movement of the first button portion by means of stops arranged on the guide housing. The first button portion, in this connection, is loaded by means of a spring, which is supported on the guide housing, into its initial position. The advantage connected with this is that if the first button portion moves on account of friction in relation to the second button portion during the belt-tightening process jointly with the second button portion in the first instance in the belt-tightening direction, the first button portion meets with a stop of the guide housing and is thereby released from the second button portion, whereby the desired relative movement between the button portions comes about. Thereafter the spring which is provided between the first button portion and the guide housing brings the first button portion back into the initial operating position in which it is held fast by means of a further stop of the guide housing.

In a further embodiment of the invention, the first button portion is inserted with a guide rod into a coordinated channel which is formed on the second button portion, with the two button portions being connected with each other by means of a pin in the initial position of the fastener body. For effecting cancellation of this connection in the belt-tightening process, the pin is provided with an inertia mass so that during the belt-tightening movement the acting inertial forces release the pin from its connection with the first button portion so that the first button portion is freed and can be displaced relatively in relation to the second button portion under the effect of a relevant spring so that the first button portion remains in the operating position of the fastening mechanism, whilst the second button portion follows the belt-tightening movement of the fastener body.

BRIEF DESCRIPTION OF THE DRAWINGS

For a better understanding of the invention and to show how the same may be carried into effect, reference will now be made, by way of example, to the accompanying drawings, in which:

FIG. 2a shows the device of FIG. 2 in section along the line 2a—2a;

DESCRIPTION OF THE PREFERRED EMBODIMENTS

Figure 1:
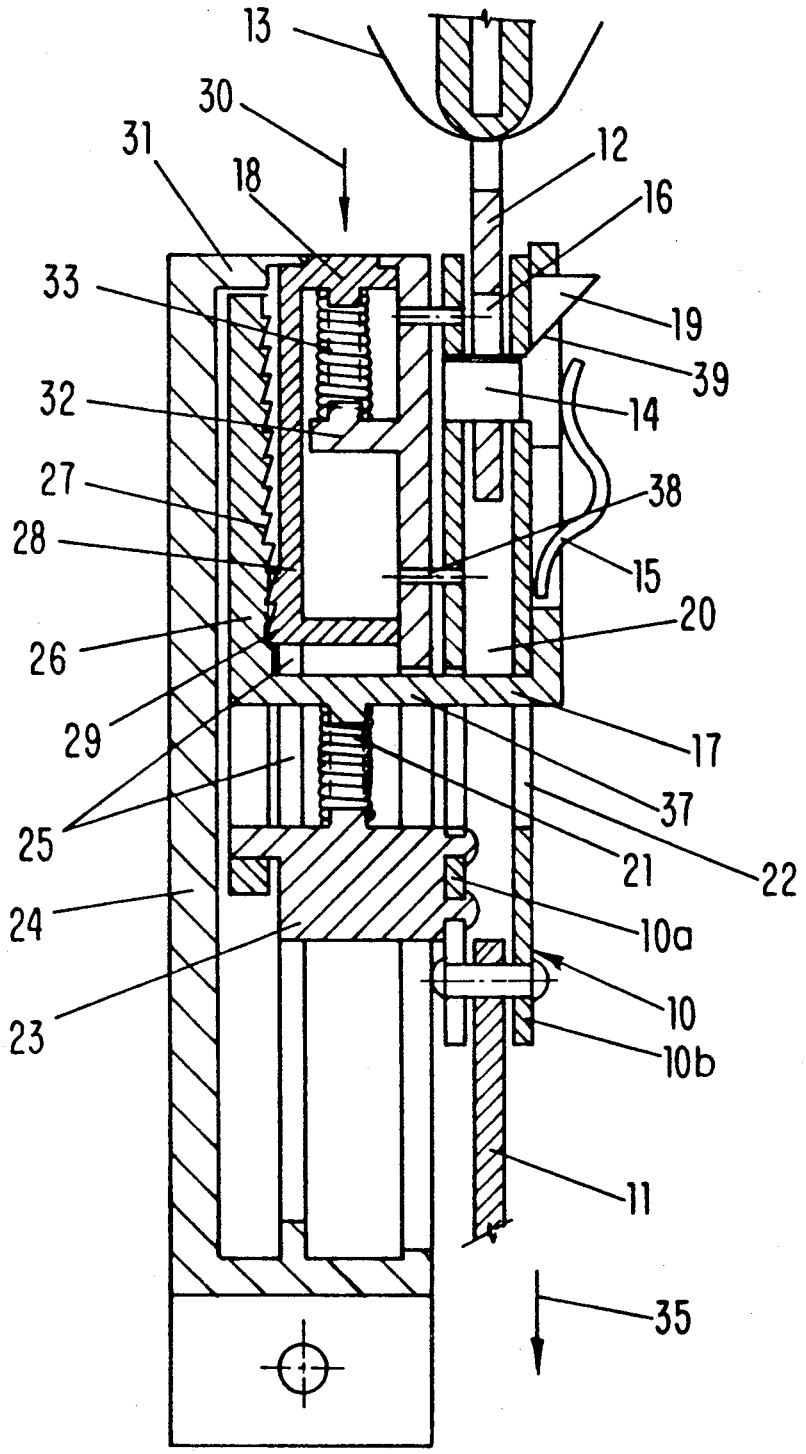
FIG. 1 shows a safety belt fastening device in longitudinal section in its normal functional position with its fastening tongue locked.
Figure 2:
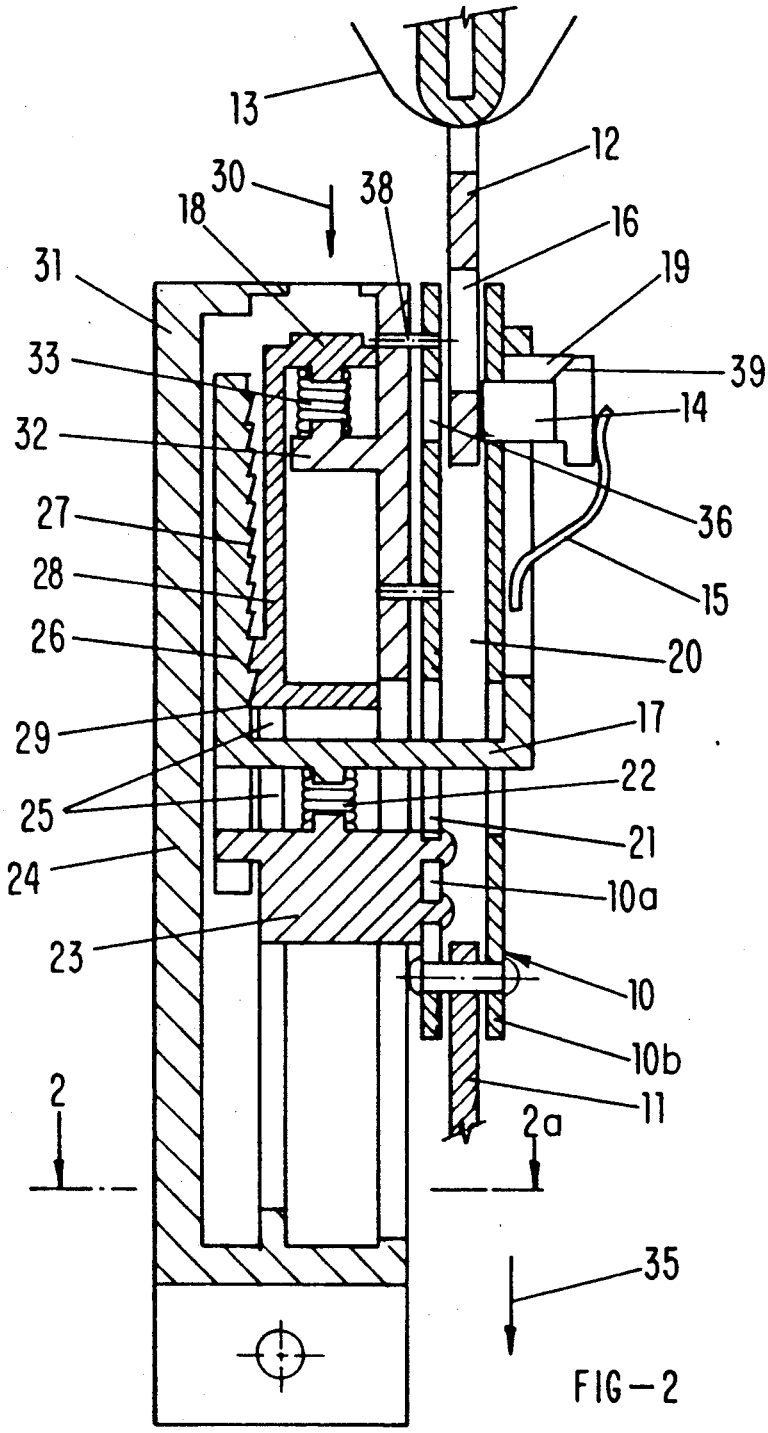
FIG. 2 shows the fastening device of FIG. 1 with the upper button portion pressed down to release the fastening tongue.
Figure 2A:
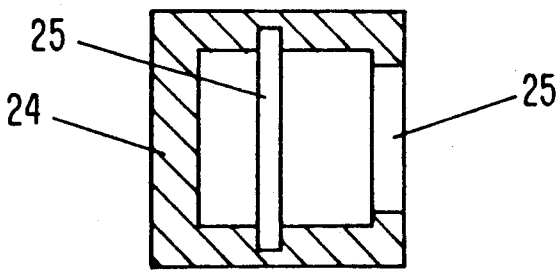
Figure 3:
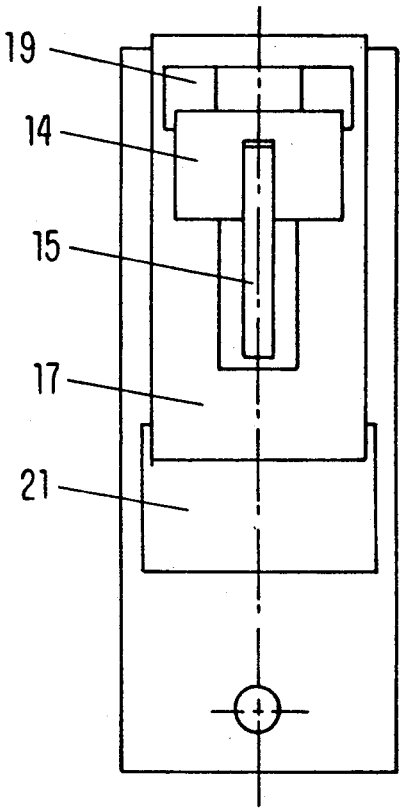
FIG. 3 is a partial plan view of FIG. 1.

Referring first to FIGS. 1 and 2, the safety belt fastening device consists of a fastener body 10 which is connected, by way of an anchoring portion 11, with the vehicle or with a drive arrangement, which is not further represented, for a belt-tightening movement (arrow 35) of the fastener body 10. It is possible to insert into an insert path 20 between two parallel fastener body plates 10a, 10b a fastening tongue 12 on which acts the belt band 13 of a safety belt system. For locking the fastening tongue 12 a fastening mechanism 14, which is well known in the prior art and need not be explained in detail to a person skilled in the art, in the form of a fastening bar 14 which can be moved perpendicularly to the movement path of the fastening tongue 12, respectively, to the insert path 28, and which is loaded by means of a fastening spring 15 into its locking position (FIG. 1) in which it penetrates a recess 16 of the fastening tongue 12 and a cutout 36 of the lower fastener body plate 10a and locks the latter fast in the fastener body 10.

The movement of the fastening bar 14 may be understood by comparing FIGS. 1 and 2. FIG. 2 shows the fastening bar 14 moved out of engagement with the cutout 36 of the lower fastener body plate 10a and the recess 16 of the fastening tongue 12 so that in the position shown in FIG. 2 the fastening tongue 12 is released and may be removed from the fastener body 10.

A two-part release button with a upper button portion 18 and a lower button portion 17 is arranged in the fastening device as an operating element for releasing the fastening bar 14 into the position shown in FIG. 2. The lower button portion 17 cooperates with the fastening bar 14 by way of a projection with a butting slope 19 when releasing. The fastening bar 14 and the projection are provided as one piece. The head portion of the fastening bar 14 is provided with a corresponding slanted portion 39 which is engaged by the butting slope 19 such that during a longitudinal displacement of the lower portion 17 parallel to the stationary fastener body plates 10a, 10b the fastening bar 14 is removed from the cutout 36 of the lower fastener body plate 10a and from the recess 16 of the fastening tongue 12. For this purpose, the lower button portion 17 is movable in recesses 21 of the fastener body plates 10a, 10b, the lower button portion 17 having a leg portion 37 that penetrates the recesses 21 so that the lower button portion 17 is movable relative to the fastener body plates 10a, 10b. The lower button portion 17 is loaded by way of a pressure spring 22 into the initial position (FIG. 1) corresponding with the fastening position of the fastening bar 14 in which the fastening bar 14 is not yet loaded by the projection (butting slope 19) and is in the locking position for the fastening tongue 12.

In order to provide sufficient play for the belt-tightening movement in the direction of arrow 35, there is arranged parallel to the fastener body 10 with its fastener body plates 10a, 10b a guide housing 24 for the button portions 17, 18, which housing has slots 25, corresponding to the length of the belt-tightening stroke exerted in the direction of arrow 35 on the anchoring portion 11, for the movement of the leg portion 37 of the lower button portion 17 in the guide housing 24 so that the unit comprised of the plates 10a, 10b and the lower button portion 17 connected thereto is slidable along the guide housing 24. The lower fastener plate 10a of the fastener body 10 is secured by shear pins 38 at the guide housing 24 against accidental displacement.

At the upper end face of the guide housing 24 the upper button portion 18 is arranged which is slidable in the direction of arrow 30 into the guide housing 24 until the button portion 18 abuts at the inner stop 32 of the guide housing 24. The upper button portion 18 is forced into its initial position by a spring 33 and is held in this position by an abutment stop 31 formed as a part of the guide housing 24.

The lower button portion 17 has, in the guide housing 24, a leg 26 with a tooth construction 27 extending from the leg portion 37. The upper portion 18 can be moved in the insert path thus established, the upper button portion 18 including an extension 28 which is arranged parallel to the leg 26 and parallel to the longitudinal side of the guide housing 24 and which has for cooperation therewith a coordinated, outwardly oriented tooth construction 29. The tooth constructions 27, 29 interlock in a form-locking manner and are aligned with regard to their tooth flanks so that the tooth flanks are bevelled in opposition to the operating direction 30 for the release movement of the release button. Thus sliding-off of the tooth constructions 27/29 with a relative movement of the two button portions 17, 18 in relation to each other is possible only in opposition to the direction (arrow 30) of button movement for the release action, the two button portions being locked in each position in relation to each other for the release action.

Due to this arrangement the upper button portion 18 and the lower button portion 17, when pressing the upper button portion 18 into the guide housing 24 in the direction of arrow 30, are arrested relative to one another such that simultaneously with the displacement of the upper button portion 18 the lower button portion 17 is moved in a downward direction within the slots 25 of the guide housing 24 and the recesses 21 of the stationary fastener body plates 10a, 10b that are connected with the shear pins 38 to the guide housing 24. However, after the shear pins 38 have been sheared off, the lower button portion 17 with its leg 26 can glide along the extension 28 of the upper button portion 18 when the fastener body plates 10a, 10b with the lower button portion 17 connected thereto is moved relative to the stationary guide housing 24 so that the upper button portion 18 remains in its position relative to the guide housing 24.

The upper button portion 18 is arranged so as to be movable in the guide housing 24 between two stops 31, 32, which limit its path, with clearance under the action of a spring 33.

For the functioning of the device two movements must be discerned: first, the removal of the fastening bar 14 in order to release the fastening tongue 12 from its locking position; and second, the belt-tightening movement of the fastener body 10 in order to tighten the belt 13, connected to the fastening tongue 12 that is locked within the fastener body 10, in the direction of arrow 35.

FIGS. 1 and 2 show the movements during normal operation of the device.

The normal functional position of the safety belt fastening device in which the upper portion 18 is inserted into the lower button portion 17 is in the first instance as shown in FIG. 1. Pressure on the operating area of the upper button portion 18 displaces the upper button portion 18 on account of the tooth construction locking system 27/29 jointly with the lower button portion 17 in the recesses 21, in the direction of arrow 30, so that the butting slope 19 lifts the fastening bar 14 out of the insert path 20 and frees the fastening tongue 12. Subsequently, the spring 22 guides the two-part release button 17, 18 back into its initial position.

FIG. 1 shows the locked position of the device in which the fastening bar 14 is located within the recess 16 of the fastening tongue 12 and within the cutout 36 of the lower fastener body plate 10*a*. When it is desired to unlock the device for releasing the fastening tongue 12, the operating person applies pressure with his finger on the upper button portion 18 in the direction of the arrow 30 and forces the upper button portion into the guide housing 24. Simultaneous with the displacement of the upper button portion 18 the extension 28 and, due to the intermeshing toothings 27, 29, the leg 26 of the lower button portion 17 are moved downward (arrow 30) so that the lower button portion 17 with its coordinated leg portion 37 is moved in a downward direction (arrow 30) within the slots 25 of the guide housing 24 which is stationary. Since the fastener body plates 10*a*, 10*b* are fixedly connected with the shear pins 38 to the stationary guide housing 24, the lower button portion 17 is also displaced within the recesses 21 of the fastener body plates 10*a*, 10*b*, whereby the projection (19) of the lower button portion 17 engages with its butting slope 19 the slanted portion 39 of the fastening bar 14 and, due to its movement relative to the fastener body plates 10*a*, 10*b*, moves the fastening bar 14 perpendicular to the plane of the fastener body plates 10*a*, 10*b* such that the fastening bar 14 is released from the cutout 36 of the lower fastener body plate 10*a* and from the recess 16 of the fastening tongue 12, thereby releasing the fastening tongue 12.

Figure 4:
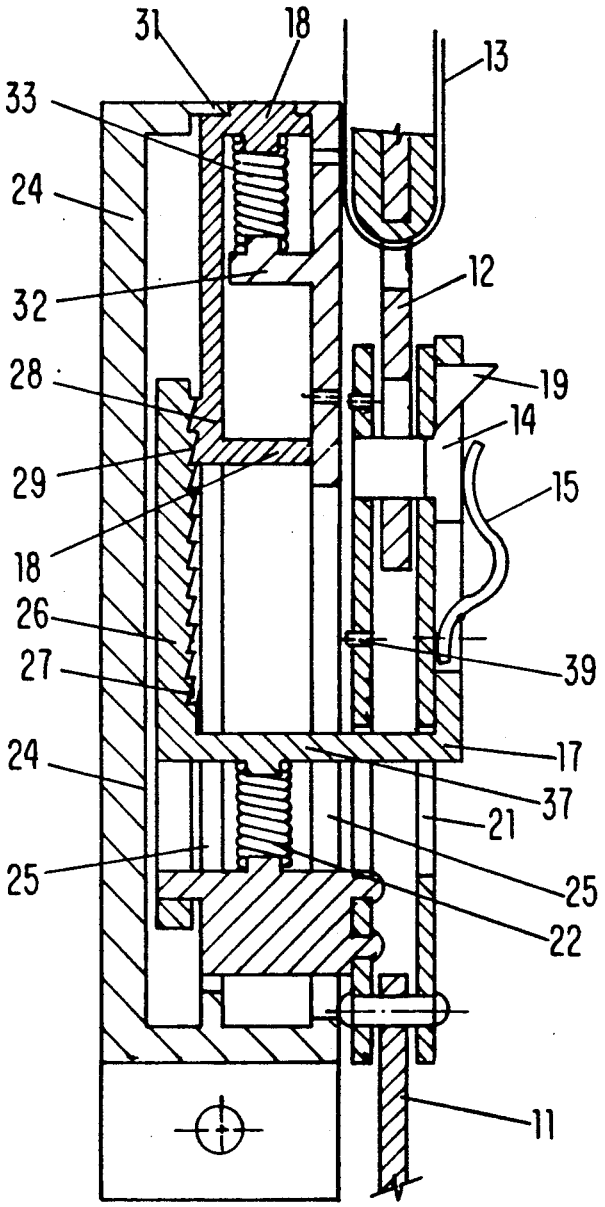
FIG. 4 shows the device of FIG. 1 after completion of the belt-tightening movement.

When an accident occurs with the device being in the locked position of FIG. 1, a non-represented drive means is activated which acts on the anchoring portion 11 in the direction of the arrow 35 in order to pull the fastener body 10 with its fastener body plates 10*a*, 10*b* and the fastening tongue 12 connected thereto in the longitudinal direction of the guide housing 24 in the direction of the arrow 35 for tightening the belt 13 connected to the fastening tongue 12. When this movement is initiated the shear pins 38 are sheared off so that the fastener body 10 is movable relative to the stationary guide housing 24. With this tightening movement the arrangement of the lower button portion 17 to the fastening bar 14 remains unchanged because the lower button portion 17 follows the movement of the fastener body 10 whereby the leg portion 37 is displaced within the slots 25 of the guide housing 24. During this movement/displacement which can be taken from comparing FIGS. 1 and 4, the tooth constructions 27, 29 of the leg 26 and the extension 28, respectively, glide on one another so that despite the movement of the lower button portion 17 together with the fastener body 10 in the direction of the arrow 35 the upper button portion 18 remains in its initial position within the guide housing 24 according to FIG. 1. FIG. 4 shows the device after the tightening movement.

In the case of a belt-tightening movement, the lower button portion 17, which is connected with the fastener body 10 by way of the recesses 21 in a form-locking manner, is moved in the tightening direction 35. At the same time, the upper button portion 18 remains in its position on account of its mass inertia, with the tooth constructions 27, 29 sliding off one another and a relative movement takes place between the two button portions. At the end of the belt-tightening movement, on account of the tooth constructions 27, 29, the upper button portion 18 and lower button portion 17 are locked for movement together in the operating direction 30 so that by means of pressure on the upper button portion 18 the lower button portion 17 executes normal releasing movement.

It is important that after the termination of the tightening movement a removal of the fastening bar 14 for releasing the fastening tongue 12 is possible even though the button portions 17 and 18 are in a different position after the tightening movement. From FIG. 4 it can be taken that, after completion of the tightening movement, the button portion 18 may be pressed into the guide housing 24 whereby via the toothing constructions 27, 29 the leg 26 of the lower button portion 17 is displaced within the recesses 21 of the fastener body plates 10*a*, 10*b* until the projection (19) of the lower button portion 17 has moved the fastening bar 14 from the cutout 16 and from the recess 16, according to the representation of FIG. 2.

If the upper bottom portion 18, on account of prevailing friction, should first also be moved in the operating direction 30/tightening direction 35, this movement is restricted by the stop 32 which tensions the spring 33 that in turn cancels the movement in the direction of arrow 35 and forces the upper button portion 18 against the stop 31 of the guide housing 24.

It is not desired to return the functional parts of the device from the position in FIG. 4 into the initial position of FIG. 1: For safety considerations it is necessary to replace the entire device after a tightening movement has taken place because the functional parts most likely would not withstand another tightening load during an accident.

Figure 5:
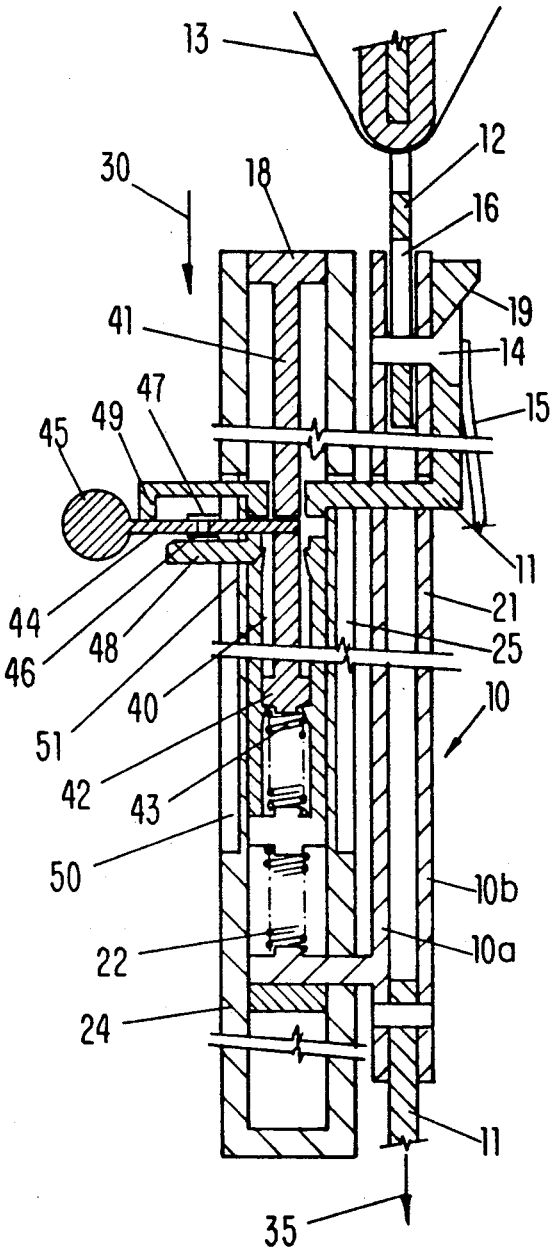
FIG. 5 is a sectional view similar to FIG. 1 but of a different embodiment of safety belt fastening device.
Figure 6:
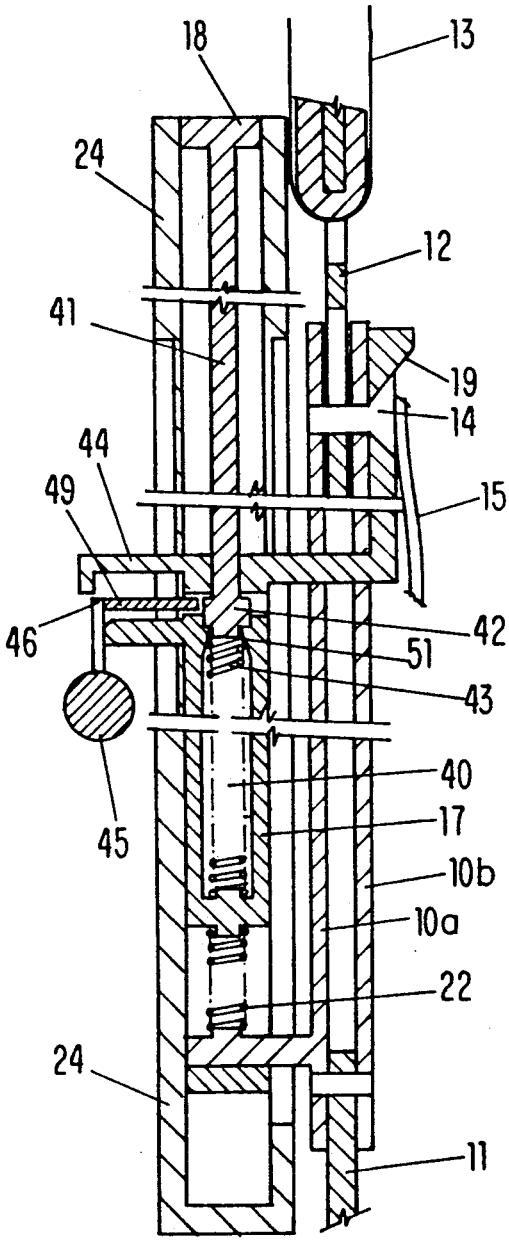
FIG. 6 shows the fastening device of FIG. 5 at the end of a belt-tightening movement.

In the alternative embodiment shown in FIGS. 5 and 6, the lower button portion 17 forms a channel 40 in which an extension rod 41 of the upper button portion 18 can move with a guide portion 42 against the action of a pressure spring 43.

The lower button portion 17 and the upper button portion 18 are connected with each other by means of a pin 44 which penetrates the portions 40, 41 and the free end of which projects out of the guide housing 24 and there bears an inertia mass 45. The pin 44 has a joint 46 which is outside the guide housing 24 and which is encompassed by a shear sleeve 47 so that the pin 44 is held in its extended position between two abutments 48, 49. In the guide housing 24 a slot 50 is formed for the guidance of the parts 44, 48, 49. For the purpose of fixing the upper button portion 18 at the end of the relative movement in relation to the lower button portion 17 when the belt-tightening process takes place there are holding lugs 51 which project into the channel 40 and which, for permitting extraction of the upper portion 18, allow the guide portion 42 to pass in the channel 40 and only arrest it in the counter-direction, that is, in the operating direction 30.

The fastening device of FIGS. 5 and 6 thereby functions in a manner comparable with the embodiment described with reference to FIGS. 1 and 2. For the purposes of normal operational movement the two button portions 17, 18 are connected with each other by means of the pin 44. With a belt-tightening movement, the second lower button portion 17 follows the fastener body 10, in which case the inertia mass 45 is supported at the abutment 49 and the pin 44 maintains the connection of the button portions 17, 18.

At the end of the belt-tightening movement, the shear sleeve 47 breaks away on account of the inertial forces which originate from the inertia mass 45 and thus frees the joint 46. The inertia mass 45 swings downwards and thereby draws the pin 44 out of the extension rod 41 so that the form-locking connection of the button portions 17, 18 is canceled. As a result, the spring 43 pushes the first upper button portion 18 back out into the initial operating position in which the upper button portion 18 is locked by means of the holding lugs 51 with the lower button portion 17 such that a pressure on the upper button portion 18 in the operating direction 30 brings about a corresponding releasing movement of the lower button portion 17.

The present invention is, of course, in no way restricted to the specific disclosure of the specification and drawings, but also encompasses any modifications within the scope of the appended claims.

What we claim is:

1. In a safety belt fastening device for a safety belt system having a belt-tightening device that acts upon said fastening device and a belt fastening tongue that is latched in said fastening device, said safety belt fastening device comprising a fastener body having a fastening mechanism for said fastening tongue, and a spring loaded release button that acts on said fastening mechanism, the improvement wherein:

said release button comprises two button portions which are coupled together and are movable relative to one another;

a first one of said button portions is connected to said fastener body;

a second one of said button portions is arranged above said first button portion in a direction opposite to a belt-tightening direction to be accessible for actuation;

in a belt-tightening process, said first button portion follows a movement of said fastener body and said second button portion remains in an operating position determined by a rest position of said fastener body; and for a release of said fastening tongue, said second button portion is actuated in the belt-tightening direction and pushes said first button portion coupled thereto in the belt-tightening direction.

2. A safety belt fastening device according to claim 1, in which said second button portion and said first button portion are coupled via a connection that is releasable in a direction opposite to a release direction of said release button and is arrested in said release direction of said release button.

3. A safety belt fastening device according to claim 1, in which said second button portion is arranged in a guide housing and is movable with clearance relative to said guide housing, with said clearance in directions of movement of said second button portion being determined by corresponding stops attached at said guide housing, and with said second button portion, in order to maintain an operating position, being loaded by a pressure spring that is supported at said guide housing.

4. A safety belt fastening device according to claim 1, in which said second button portion is attached to said first button portion via a connecting device, that is releasable during said belt-tightening process, and is loaded by a pre-loaded spring, arranged between said button portions, in a direction opposite to a release direction of said release button.

5. A safety belt fastening device according to claim 4, in which said second button portion is disposed in a channel of said first button portion over a length of a belt-tightening path of said fastener body, with a means provided at said first button portion for holding said second button portion in position relative to said first button portion in said release direction of said release button.

6. A safety belt fastening device according to claim 4, in which said connecting device comprises a longitudinally movable pin that penetrates said first and second button portion and is equipped, at a free end thereof, with an inertia mass.

7. A safety belt fastening device according to claim 1, in which said release button is divided, in a direction parallel to a belt-tightening direction, into adjacent first and second button portions, with said first portion being held fast in an operating position by a holding device disposed at a portion of a vehicle and is fastenable via said second button portion by a fastening device at an end of said belt-tightening stroke.

8. A safety belt fastening device according to claim 7, in which said holding device is disposed at a vehicle seat.

9. A safety belt fastening device according to claim 1, in which said release button is arranged, with respective connecting and fastening devices, in a housing of said fastening device.

10. A safety belt fastening device according to claim 1, in which said release button is arranged, with respective connecting and fastening devices, in a separate housing, with said first button portion being functionally coupled with said fastening mechanism of said fastener body.

11. A safety belt fastening device according to claim 1, in which a connection between said first and said second button portion is established in a telescopic manner with several components that are insertable into each other.

* * * * *